US010487491B2

(12) United States Patent
Delaney

(10) Patent No.: US 10,487,491 B2
(45) Date of Patent: Nov. 26, 2019

(54) URINE BACKSPLASH DEVICE

(71) Applicant: Peter Gavin Delaney, Shaker Heights, OH (US)

(72) Inventor: Peter Gavin Delaney, Shaker Heights, OH (US)

( * ) Notice: Subject to any disclaimer, the term of this patent is extended or adjusted under 35 U.S.C. 154(b) by 0 days.

(21) Appl. No.: 16/056,876

(22) Filed: Aug. 7, 2018

(65) Prior Publication Data

US 2018/0340323 A1 Nov. 29, 2018

Related U.S. Application Data

(62) Division of application No. 14/611,849, filed on Feb. 2, 2015, now Pat. No. 10,066,381.

(51) Int. Cl.
*E03D 9/00* (2006.01)
*E03D 13/00* (2006.01)

(52) U.S. Cl.
CPC ..... *E03D 13/005* (2013.01)

(58) Field of Classification Search
CPC ..... E03D 13/0054
USPC ..... 4/300.3, 309, 256.1, DIG. 5, 613, 222.1
See application file for complete search history.

(56) References Cited

U.S. PATENT DOCUMENTS 5,774,905 A * 7/1998 Wager ..... E03D 13/005 4/222.1
6,055,681 A 5/2000 Lyons
6,640,350 B1 11/2003 Deutsch
7,398,565 B1 7/2008 Chou
2005/0283892 A1* 12/2005 Simeone ..... E03C 1/264 4/309

OTHER PUBLICATIONS

Office Action for U.S. Appl. No. 14/611,849 dated Feb. 9, 2017, 15 pages.
Final Office Action for U.S. Appl. No. 14/611,849 dated Oct. 27, 2017, 10 pages.
Notice of Allowance for U.S. Appl. No. 14/611,849 dated May 17, 2018, 13 pages.

* cited by examiner

*Primary Examiner* — Lauren A Crane
(74) *Attorney, Agent, or Firm* — Amin, Turocy & Watson, LLP

(57) ABSTRACT

A device that mitigates urine backsplash in most types of conventional urinals. The device includes low-impact angled plates (or fins) to facilitate deflection and mitigate splash back from urine streams. In an aspect, a plurality of flexible or rigid plates are angled towards a user (e.g., sixty degrees), which allows for the urine stream to plane or glide across the respective plate surfaces and not splash back on the user.

17 Claims, 17 Drawing Sheets

URINE BACKSPLASH DEVICE

RELATED APPLICATION

The subject patent application is a divisional of and claims priority to U.S. patent application Ser. No. 14/611,849, filed Feb. 2, 2015, and entitled "URINE BACKSPLASH DEVICE." The entirety of the foregoing patent application is hereby incorporated herein by reference.

TECHNICAL FIELD

This disclosure generally relates to urine backsplashes.

BACKGROUND OF THE INVENTION

Many attempts have been made to attempt to correct the problem of urinal splash back. Various conventional urine backsplash products either rely upon bristle technology that disperses urine stream upon impact, or plastic mats with textured surface that deflect urine stream. These devices intend to control splash back, but have numerous drawbacks such as, for example: are loud while in use, can smell, lack in aesthetics, or do not effectively mitigate urine splash back.

SUMMARY

A simplified summary is provided herein to help enable a basic or general understanding of various aspects of exemplary, non-limiting embodiments that follow in the more detailed description and the accompanying drawings. This summary is not intended, however, as an extensive or exhaustive overview. Instead, the purpose of this summary is to present some concepts related to some exemplary non-limiting embodiments in simplified form as a prelude to more detailed description of various embodiments that follow in the disclosure.

The subject innovation is a device that can mitigate urine backsplash in many types of conventional urinals. An embodiment includes low-impact angled plates (or fins) to facilitate urine stream deflection and mitigate splash back from urine stream. In an aspect, a plurality of flexible or rigid (e.g., Plexiglass) plates are angled towards a user (e.g., sixty degrees), which allows for the urine stream to plane across respective plate surfaces and not splash back on the user.

These and other implementations and embodiments are described in more detail below.

BRIEF DESCRIPTION OF THE DRAWINGS

FIGS. 3 C-E represent an exploded view to demonstrate individual parts.

FIG. 4 D and FIG. 4 E represent an exploded view to demonstrate the individual parts.

DETAILED DESCRIPTION

Overview

Figure 1A:
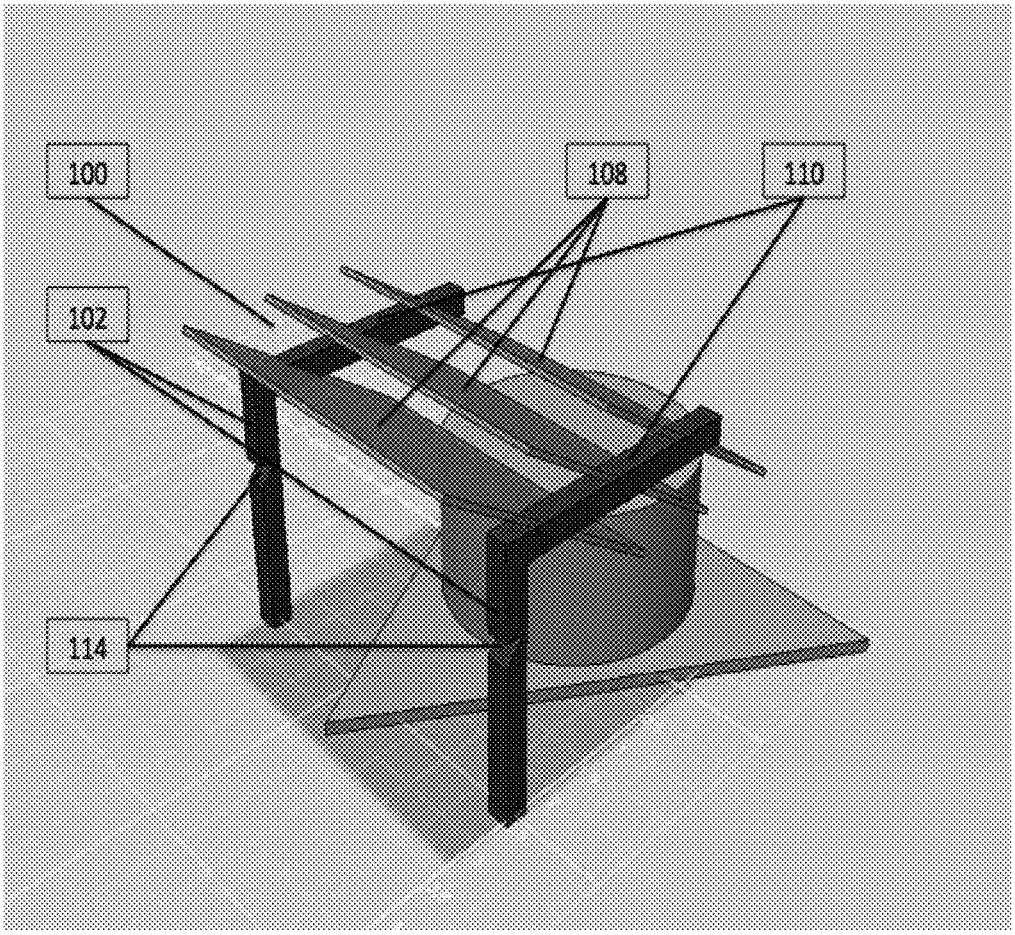
FIGS. 1A-1D depict a urine backsplash in accordance with an embodiment.
Figure 1B:
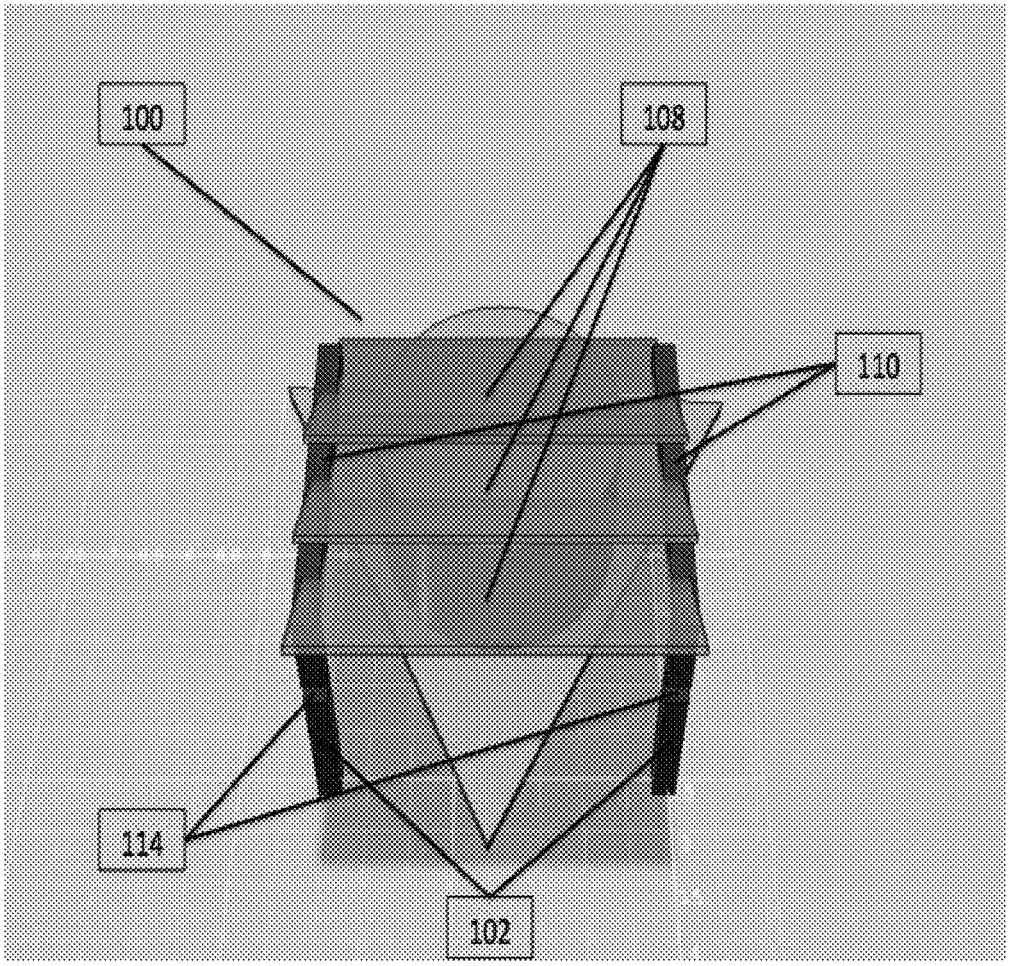
Figure 1C:
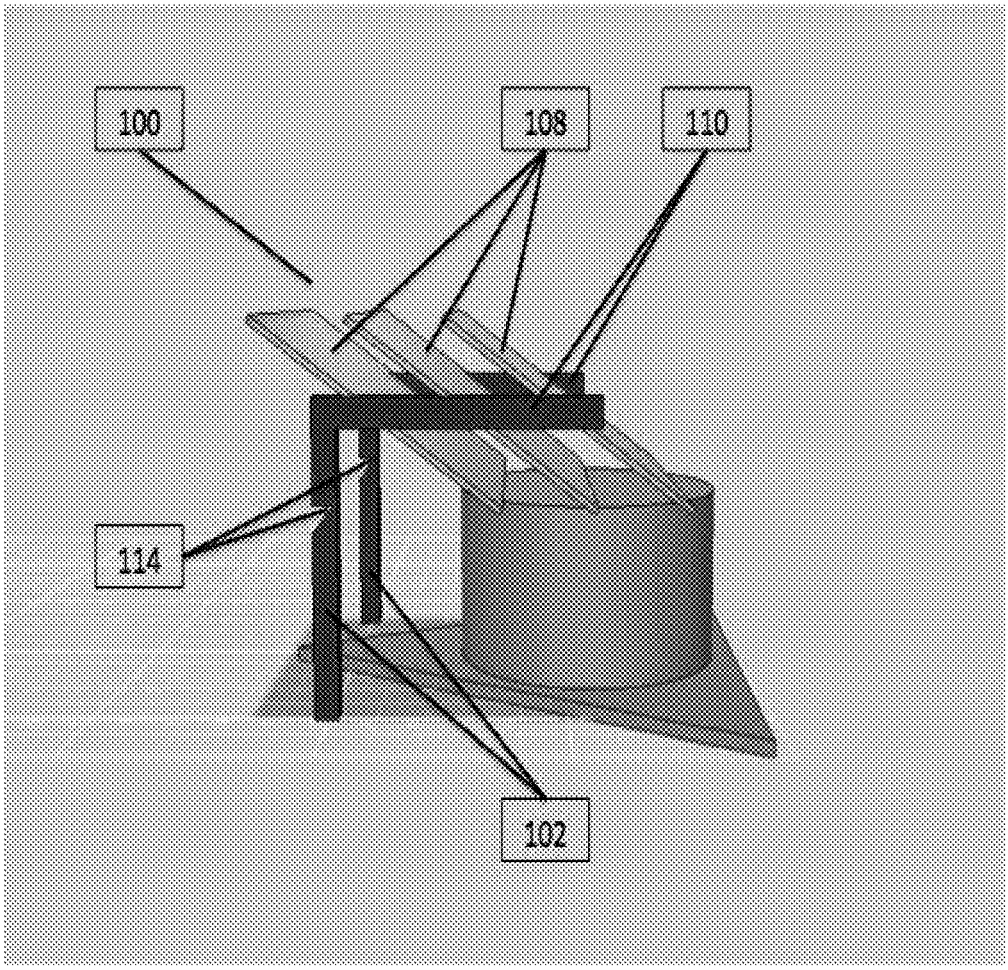
Figure 1D:
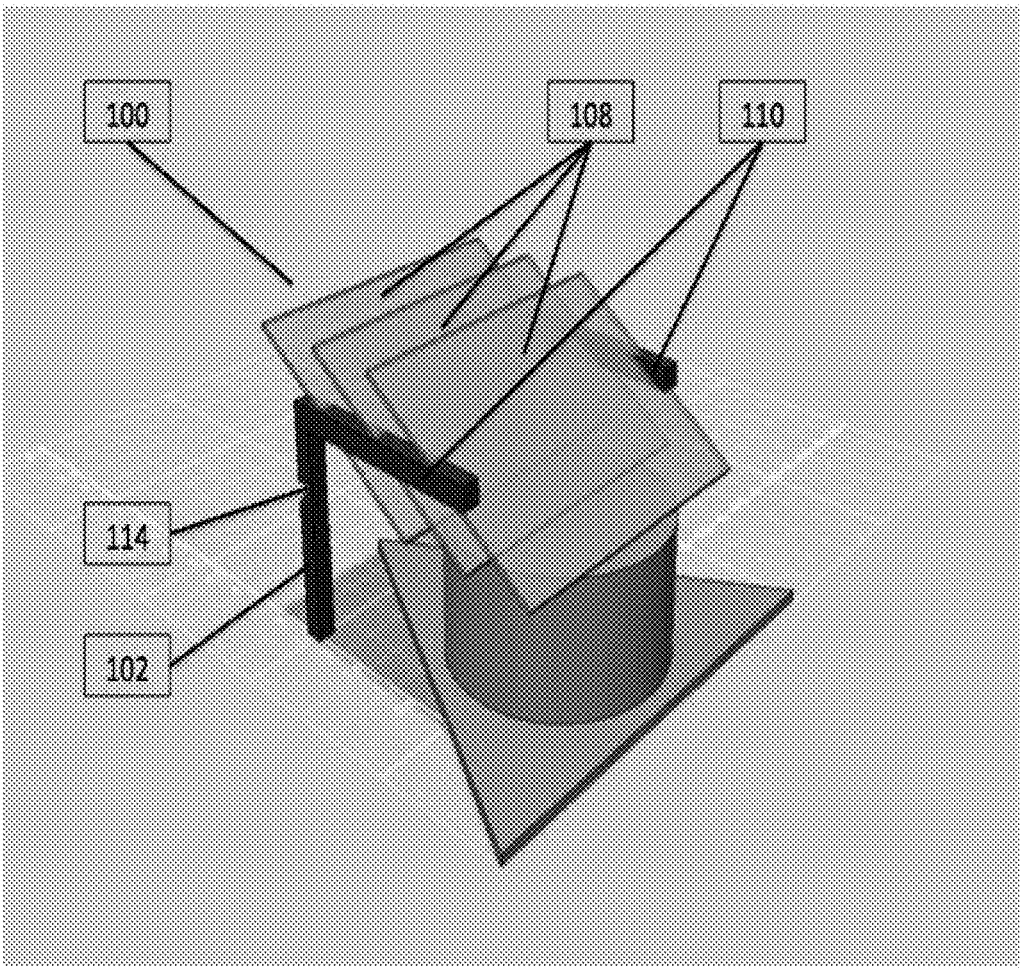

Various aspects or features of this disclosure are described with reference to the drawings, wherein like reference numerals are used to refer to like elements throughout. In this specification, numerous specific details are set forth in order to provide a thorough understanding of this disclosure. It should be understood, however, that certain aspects of this disclosure may be practiced without these specific details, or with other methods, components, materials, etc. In other instances, well-known structures and devices are shown in block diagram form to facilitate describing this disclosure.

Figure 2A:
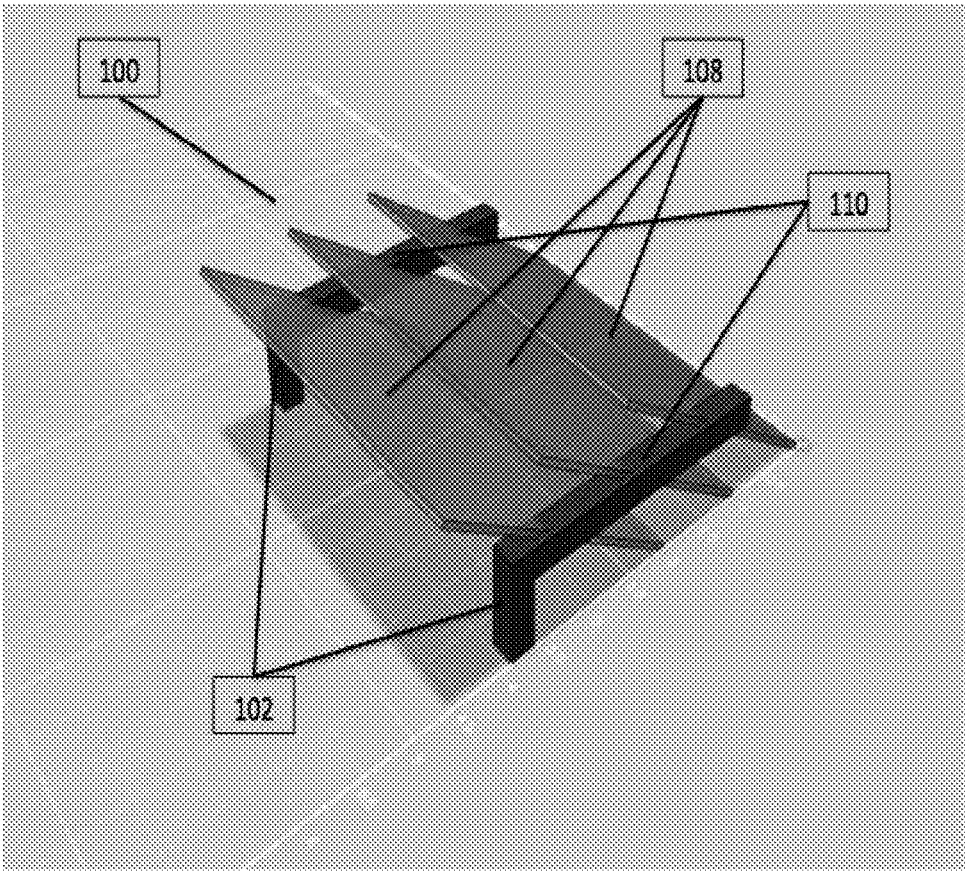
FIG. 2 A and FIG. 2 B depict a urine backsplash from FIG. 1 with the legs below the score removed.
Figure 2B:
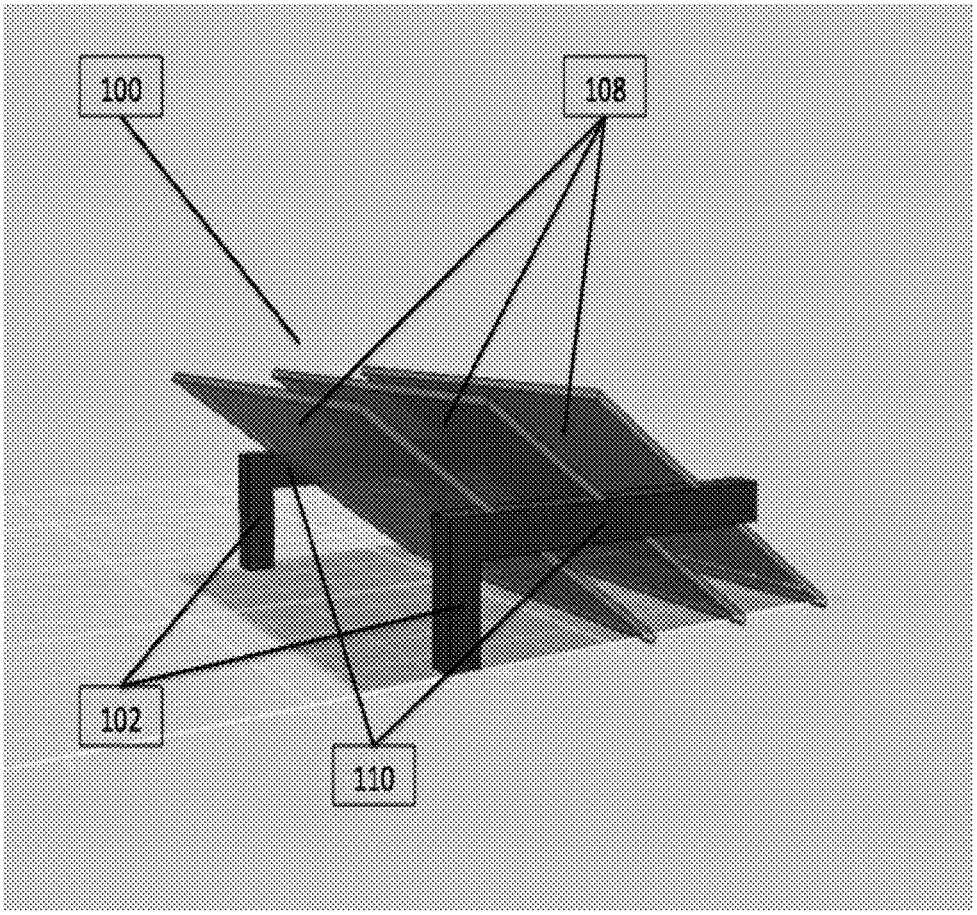
Figure 3A:
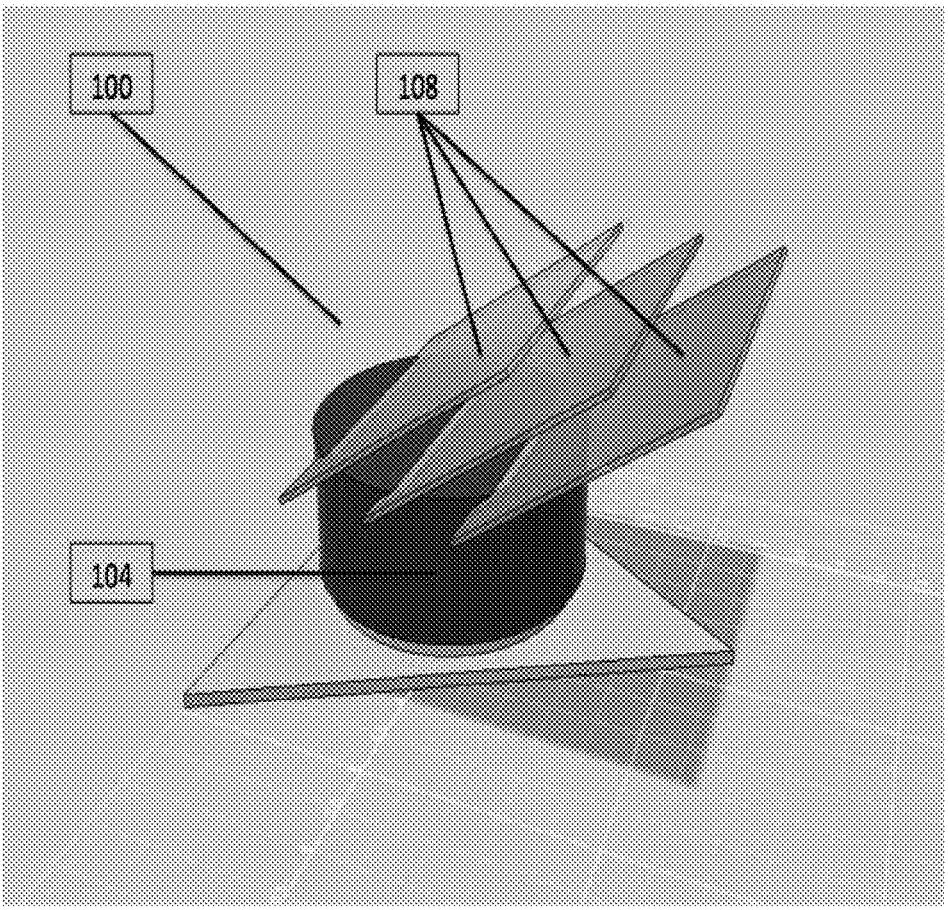
FIG. 3 A and FIG. 3 B depict an alternative urine backsplash embodiment that utilizes a donut-like base for support.
Figure 3B:
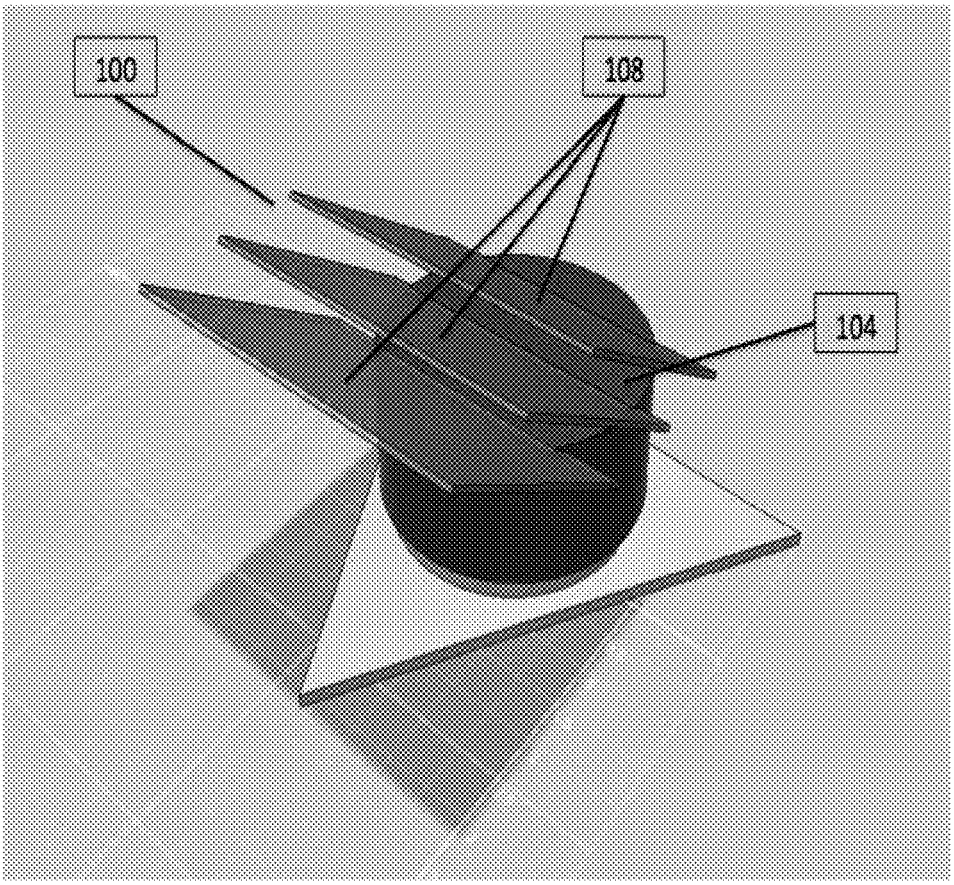
Figure 3C:
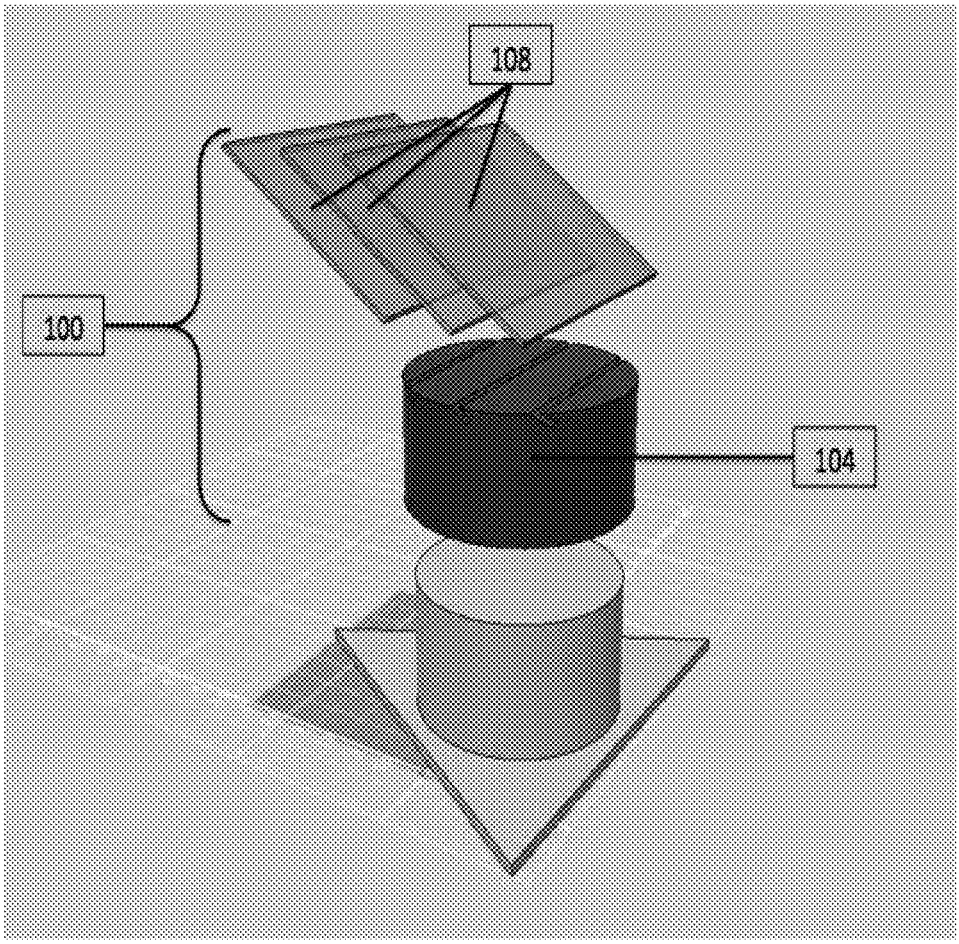
Figure 3D:
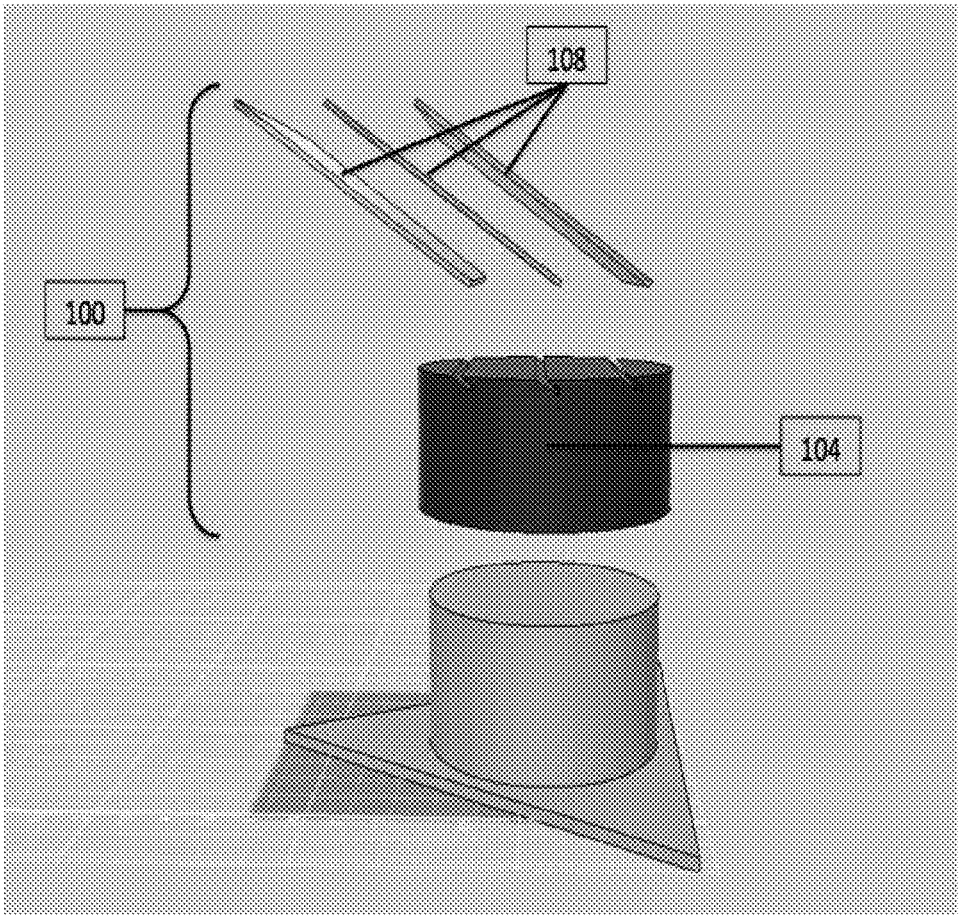
Figure 3E:
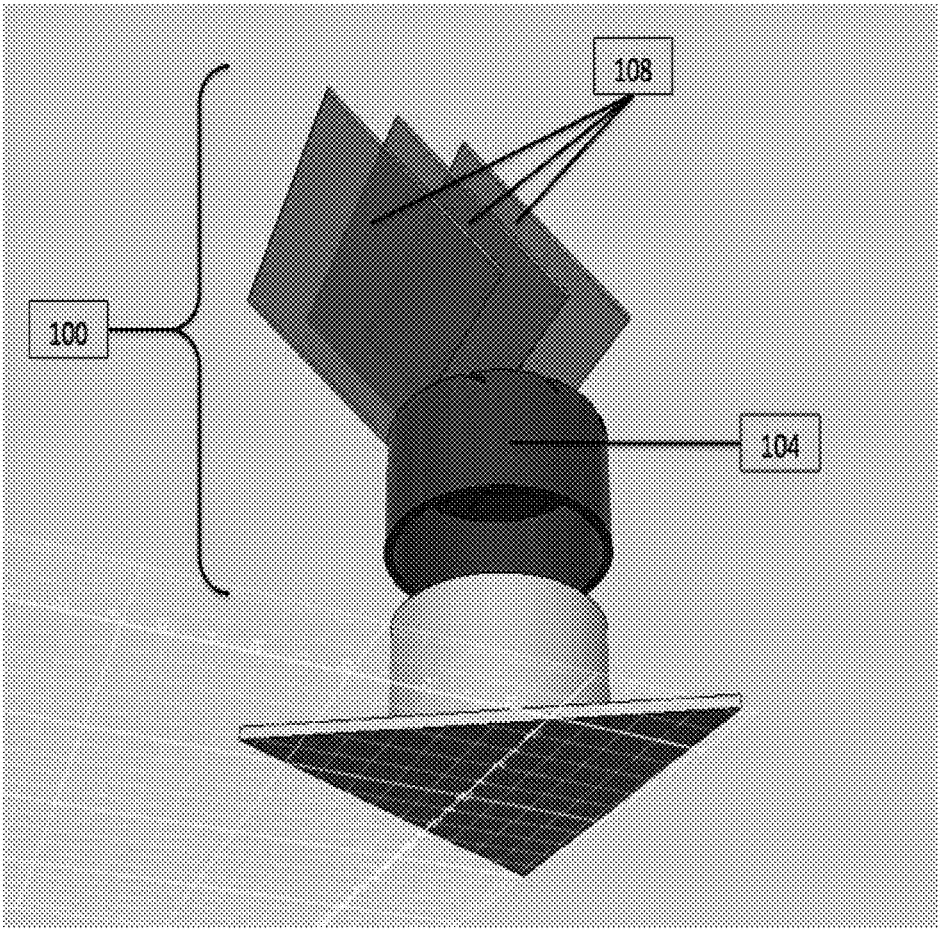

FIG. 1A illustrates a urine backsplash 100 in accordance with an embodiment. The urine backsplash 100 includes a set of legs 102 that form a supporting frame for the backsplash 100. The legs 102 are configured to receive a set of plates 108. The legs 102 include a set of mounts 110 that support and position the plates 108 in substantially parallel arrangement to one another, and position the plates 108 at an angle (e.g., within the range of 10-85 degrees) towards the user, which allows for the urine stream to plane or glide across (rather than splash from) the respective plate surfaces. In an embodiment, the legs 102 can be scored 114 so that respective bottom sections of the legs 102 can be removed to adjust height of the backsplash as illustrated in FIGS. 2 A and B (e.g., when height to accommodate a urinal cake is not needed).

The legs 102 can be made of any suitable material (e.g., glass, plexiglass, plastic, wood, metal, polymer, paper, composite, porcelain, or combination thereof). Likewise, the plates 108 can be made of any suitable material (e.g., glass, plexiglass, plastic, wood, metal, polymer, paper, composite, porcelain, or combination thereof).

As noted above, conventional urinals as well as associated urine cakes often result in portions of a urinal stream being splashed back on a user's pants, shoes, legs, feet or the like. As can be appreciated, such drawbacks associated with conventional back splashes are highly undesirable. The subject innovation mitigates urine backsplash from occurring via receiving the urine stream and directing as well as dispersing the stream away from the user and towards the urinal drain by way of the fins (or plates). The fins (or plates), of a substantially planar surface, are angled towards the user such that they provide low impact angles for an incoming urine stream. One or more fins can be arranged in substantially parallel arrangement to facilitate collecting a urine stream that can continually vary with respect to incoming angle of dispersion as well as intensity across the respective fins.

It is to be appreciated that various embodiments can employ one or more fins that are perpendicular or at a different angle with respect to other fins (e.g., a grid like pattern). Furthermore, various embodiments can employ articulated or curved fins that direct a urine stream away from the user, towards a urinal cake or drain, and mitigate urine backsplash.

The planar characteristic of the fins 108 involved in the urine backsplash allow for images to be placed onto the device like decals, whether printed, drawn, or adhered. These images can be employed commercially (e.g., advertisements, humor, informative . . . ); for example, images of rival teams can be placed on to the fin surface and then urinated on in bathrooms at sports stadiums or in sports bars.

The images can also serve a dual purpose as targets to facilitate aim of the urine stream toward the targeted fins. Much like the "urinal flies" made famous in the urinals in airports, an image attracts the eye and serves as a target to aim at. When the stream comes in contact with the decal (target) on the plate 108 surface, the stream will be controlled and splash back effectively mitigated as a result of the low-impact angles that receive and plane, guide or glide urine across the surface of respective fins, away from the user and towards the back-end of the fins.

In an alternative embodiment, electronics (e.g., battery, sensors, LED lights) can be employed such that the plates can serve as optical guides for LED lights and emit colored lights when struck by a urine stream and detected by sensors. Light emitting diodes (LED's) could be coordinated with pressure sensors located on the mounts 110 so that when a urine stream strikes the plates, the LED's activate or light up. In the same way the user is drawn towards urinating on a target, a user can be also drawn to urinate onto the plates 108 to activate the LED's (through the pressure sensors that control the LED's). In an embodiment, audio, music or chimes can be initiated when the plates 108 are struck by a urine stream that activates pressure sensors in the mounts 110.

In another embodiment, proximity sensors can be incorporated, whether freestanding and separate from the device (e.g., placed on a wall or floor), or incorporated into the device itself. These sensors can prompt a message to be announced or a message being displayed on a screen near the urinal, or even LED's on the plates 108 to light up to direct the user to direct the urine stream towards the plates/fins.

These proximity sensors can also gauge height of a user, and servo motors in the mount 110 can automatically adjust angle at which the fins are positioned towards the user to facilitate mitigation of splash back from the urine stream.

Another embodiment can include real-time shifts in the angles of the plates 108. When a urine stream comes in contact with the plates and pressure sensors are activated in the mounts 110, servo motors also in the mounts 110 can shift the plates to more effectively mitigate splashing back by detecting when the pressure sensors encounter the least amount of pressure as the stream more smoothly joins with the plates at low-impact angles.

It is to be appreciated that one or more of the embodiments described herein can be built into a portable urinal or be integral to an existing urinal.

It is to be appreciated that although the plates 108 are depicted in substantially parallel arrangement, they can optionally be arranged in non-parallel arrangement.

In an embodiment, the mounts 110 can provide for rotational configuration so that the angle of the plates can be selectively configured by a user (e.g., to account for height of a user, whether child or adult).

FIGS. 1 B-D depict the backsplash 100 from another perspective angle.

In alternative embodiments, the fins of the device are not planar but can be curved (gradually or discretely) lengthwise to increase the angle from which the device can be used from the position at which the user is standing.

In alternative embodiments, the fins of the device are not planar but can be curved (gradually or discretely) crosswise to change how the urine enters and exits the device.

In an alternative embodiment, the bottoms of the legs 102 that come in contact with the urinal surface can have different materials attached to ensure the device remains in place while in use. These materials can range from suction cups, to rubber caps that are tacky, to possibly Velcro. They can also be detachable so that when the pegs are removed, they can be reattached to ensure the device will stay in place.

FIGS. 3 A and 3 B depict different perspectives of an alternative embodiment of the backsplash. Plates 108 are attached to a donut-like base/plate holder 104 that sits on top of the urinal cake.

FIGS. 3 C-E depict an exploded view that demonstrates the individual parts of the urine backsplash 100.

FIGS. 4 A-C demonstrate an alternative embodiment of the backsplash. In this embodiment, the plates 108 can be attached directly to the urinal cake 106 and no base is needed. In such embodiment, the plates 108 can be integrated into the urinal cake 106.

Figure 4A:
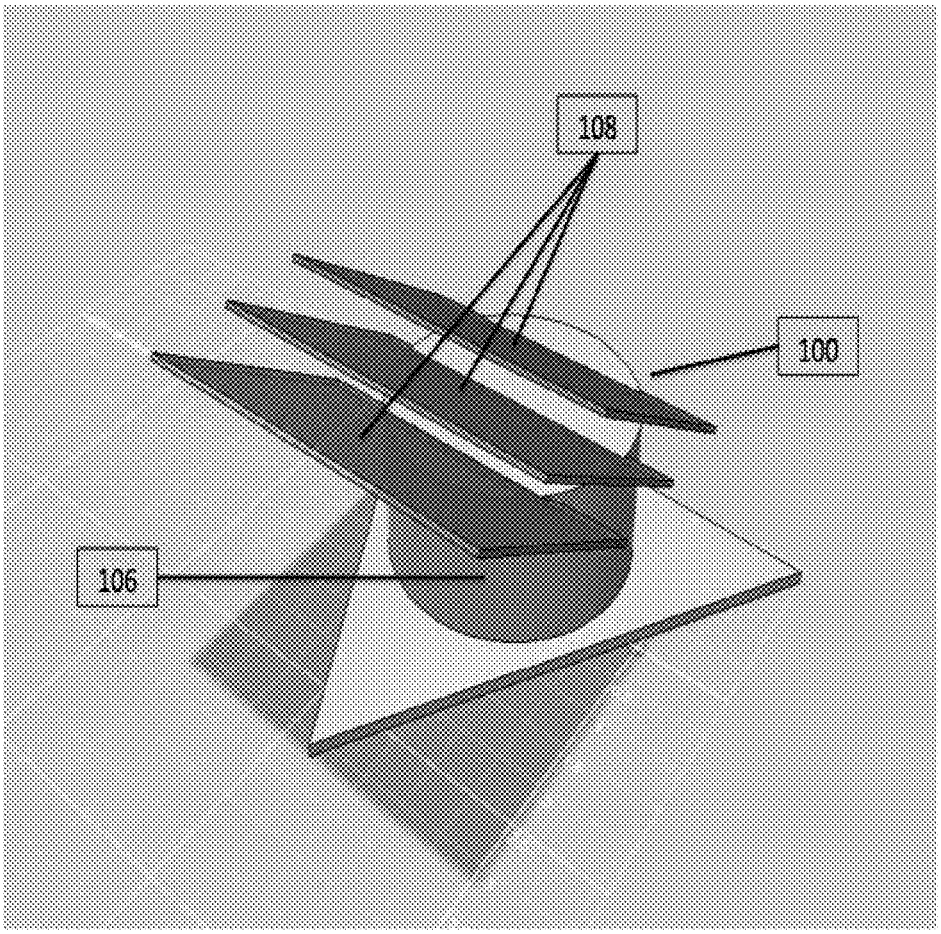
FIGS. 4 A-C depict an alternative embodiment in which, the plates integral to the urine backsplash's design are attached directly/built-in to the urinal cake.
Figure 4B:
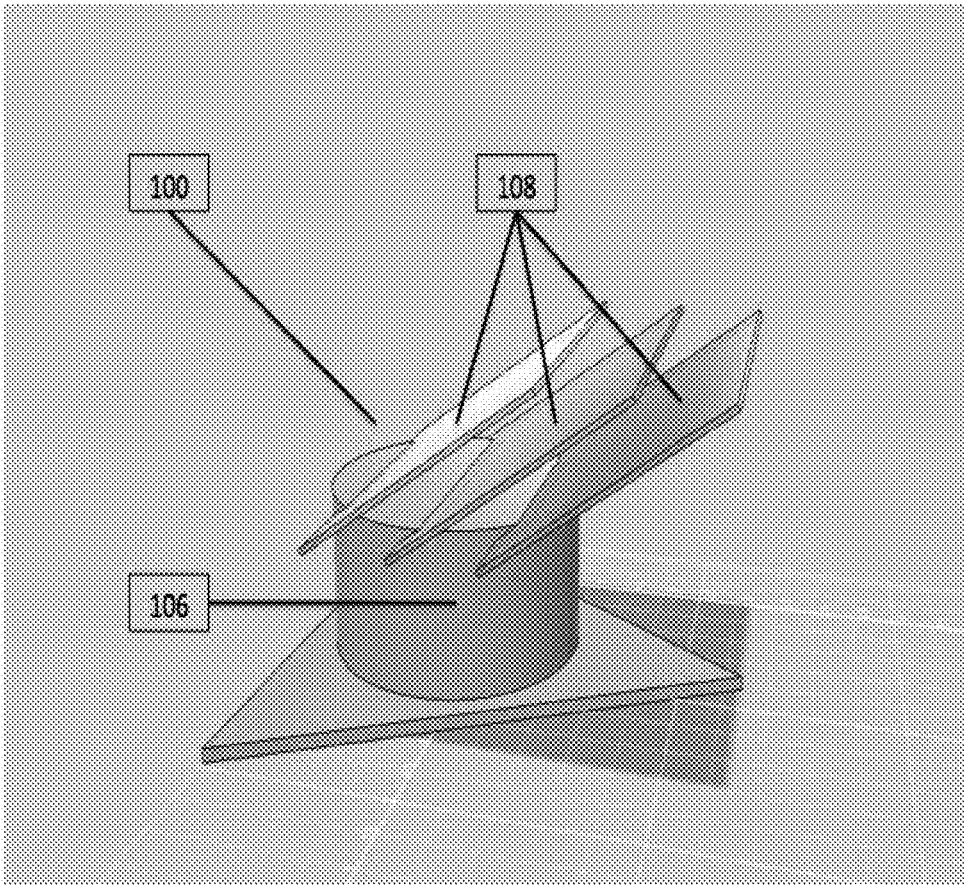
Figure 4C:
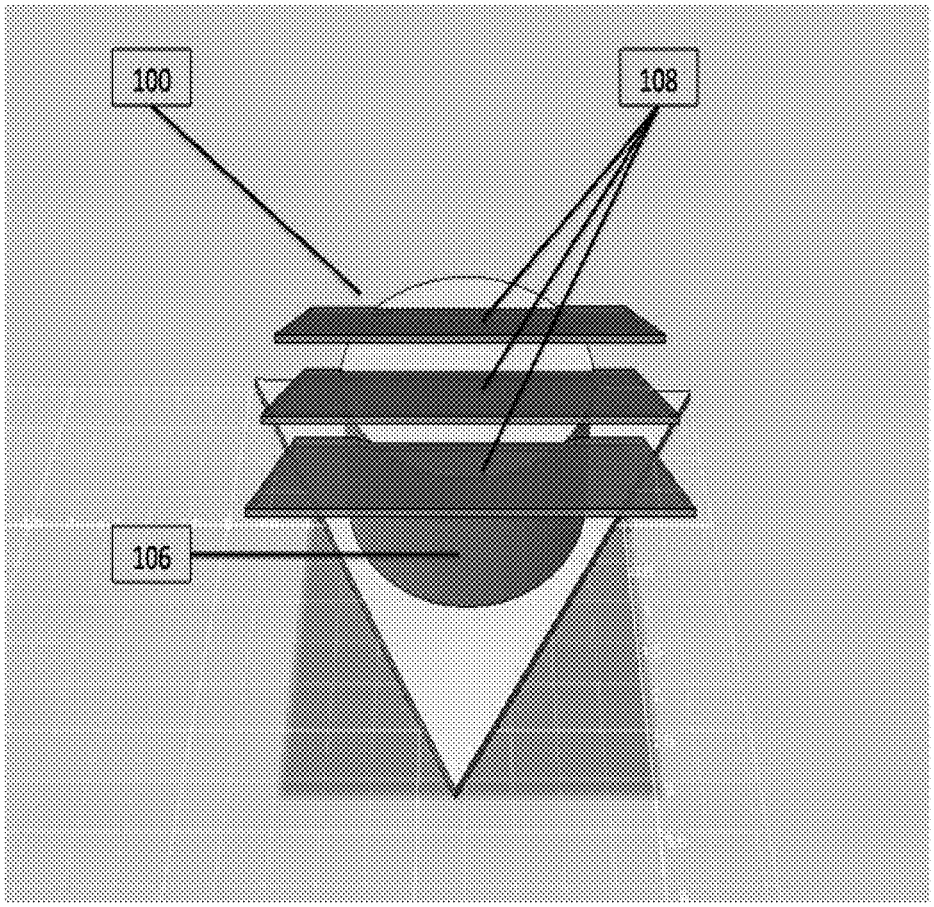
Figure 4D:
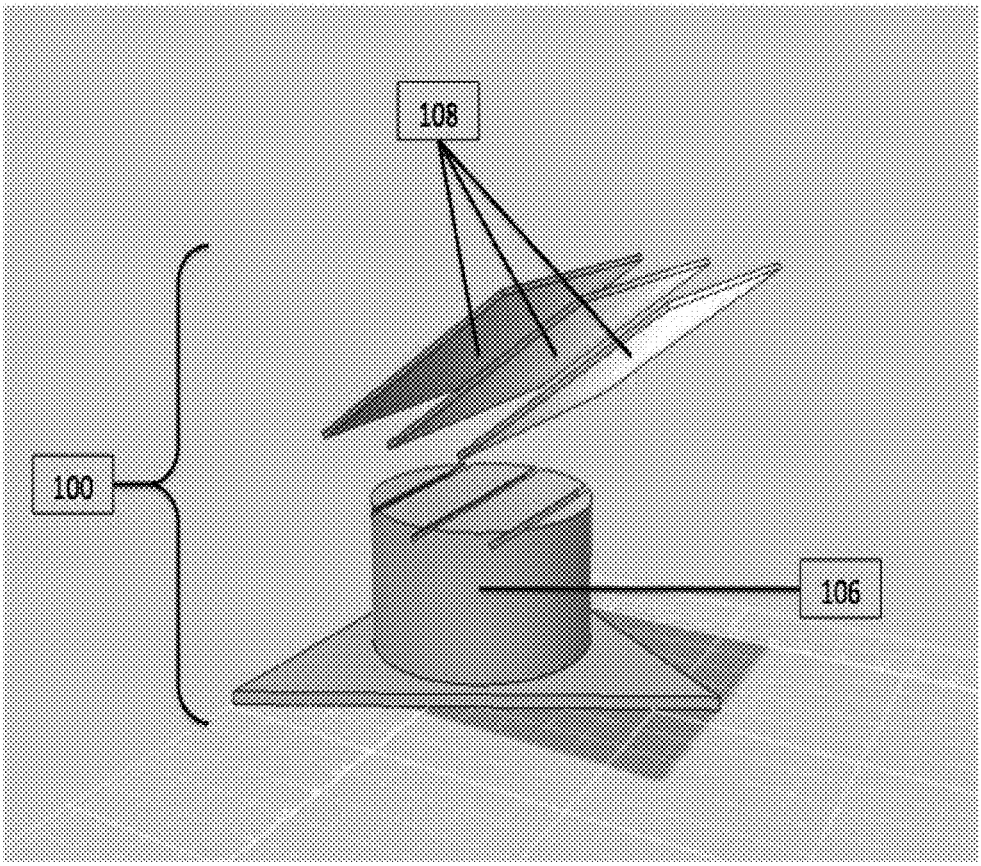
Figure 4E:
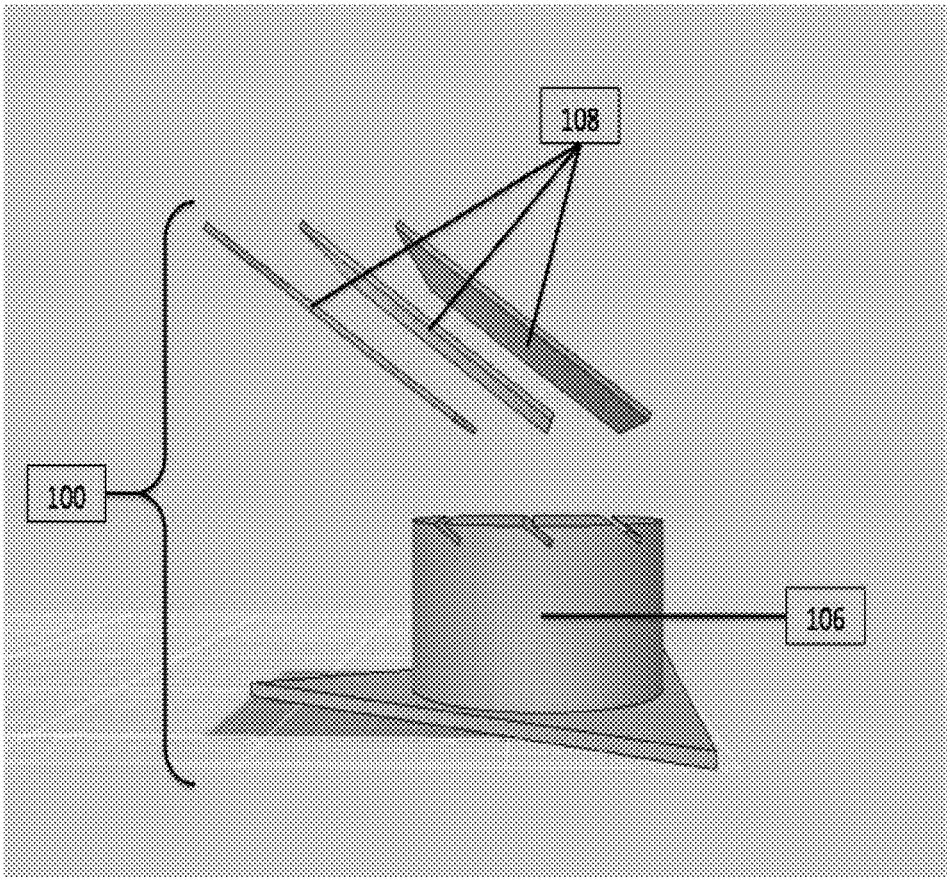

FIGS. 4D and 4E depict an exploded view of an embodiment which demonstrates the individual parts, namely, the urinal cake 106 with the notches for the plates, and the plates 108.

Figure 5:
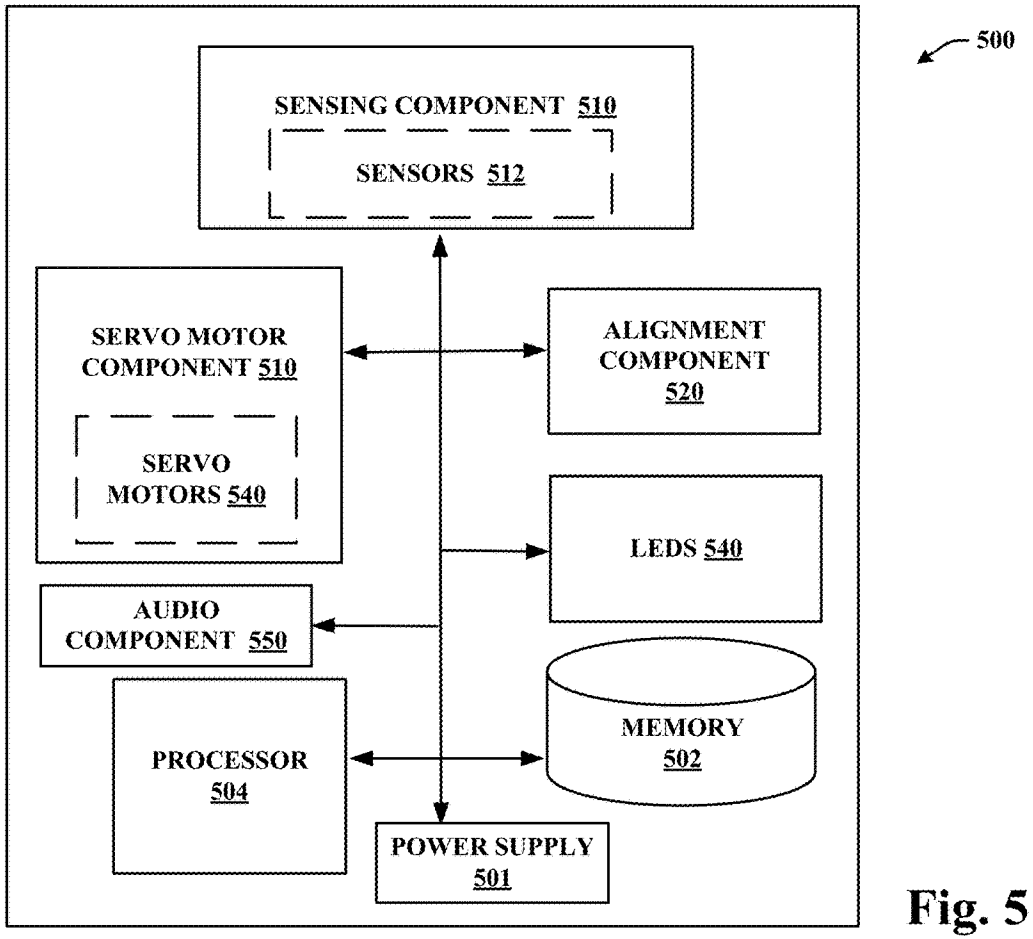
FIG. 5 depicts a schematic diagram of an implementation incorporating electronic components.

FIG. 5 A illustrates a schematic diagram of a system 500 in accordance with one or more embodiments disclosed herein that can be incorporated into the device 100 as described above. It is noted that system 500 can include functionality of various embodiments described with reference to other figures and may include additional functionality.

System 500 can include a power supply 501 (e.g., a battery), a memory 502 that stores computer executable components and a processor 504 that executes computer executable components stored in the memory 502. It is to be appreciated that system 500 can be used in connection with implementing one or more of the systems or components shown and described in connection with other figures disclosed herein. It is noted that all or some aspects of system 500 can be comprised in larger systems such as servers, computing devices, smart phones, and the like. The system 500 includes a sensing component 510 that governs one or more sensors 512 (e.g., fluid detection sensor(s), pressure sensor(s), proximity sensor(s) . . . ) that detect presence of urine striking fins of the device 100. The one or more sensors 510 can include one or more pressure sensors that detect level of pressure applied to respective fins 108 by an incoming urine stream. An alignment component 520 can adjust angle of the fins 108 via a servo motor component 530 that governs one or more servo motors 532 (or other mechanism, e.g., piezo-electric device) to adjust angle of the fins 108 so as to mitigate urine backsplash. For example, the alignment component 520 can adjust the fins 108 at one or more angles that reduce pressure applied to the fins 108 by the urine stream. Lower pressure applied to the fins 108 is indicative of the urine stream gliding across the fins 108 as compared to striking the planar surface of the fins 108. It is to be appreciated that a variety of mechanisms can be employed to adjust or position the fins 108.

Optionally, the system 500 can include LEDs 540 that can be activated for example upon detection of a urine stream. The system can also include an audio component 550 that can emit sound (e.g., a greeting, an instruction, a challenge, a tone, music . . . ) for example based upon presence of a user or urine stream.

The systems and processes described above can be embodied within hardware, such as a single integrated circuit (IC) chip, multiple ICs, an application specific integrated circuit (ASIC), or the like. Moreover, it is to be appreciated that various components described herein can include electrical circuit(s) that can include components and circuitry elements of suitable value in order to implement the embodiments of the subject innovation(s). Furthermore, it can be appreciated that many of the various components can be implemented on one or more integrated circuit (IC) chips. For example, in one embodiment, a set of components can be implemented in a single IC chip. In other embodiments, one or more of respective components are fabricated or implemented on separate IC chips.

What has been described above includes examples of the embodiments of the present disclosure. It is, of course, not possible to describe every conceivable combination of components or methodologies for purposes of describing the claimed subject matter, but it is to be appreciated that many further combinations and permutations of the subject innovation are possible. Accordingly, the claimed subject matter is intended to embrace all such alterations, modifications, and variations that fall within the spirit and scope of the appended claims. Moreover, the above description of illustrated embodiments of the subject disclosure, including what is described in the Abstract, is not intended to be exhaustive or to limit the disclosed embodiments to the precise forms disclosed. While specific embodiments and examples are described herein for illustrative purposes, various modifications are possible that are considered within the scope of such embodiments and examples, as those skilled in the relevant art can recognize. Moreover, use of the term "an embodiment" or "one embodiment" or "an implementation" throughout is not intended to mean the same embodiment or implementation unless specifically described as such.

In particular and in regard to the various functions performed by the above described components, devices, circuits, systems and the like, the terms used to describe such components are intended to correspond, unless otherwise indicated, to any component which performs the specified function of the described component (e.g., a functional equivalent), even though not structurally equivalent to the disclosed structure, which performs the function in the herein illustrated exemplary aspects of the claimed subject matter. In this regard, it will also be recognized that the innovation includes a system as well as a computer-readable storage medium having computer-executable instructions for performing the acts and/or events of the various methods of the claimed subject matter.

The aforementioned systems/circuits/modules have been described with respect to interaction between several components/blocks. It can be appreciated that such systems/circuits and components/blocks can include those components or specified sub-components, some of the specified components or sub-components, and/or additional components, and according to various permutations and combinations of the foregoing. Sub-components can also be implemented as components communicatively coupled to other components rather than included within parent components (hierarchical). Additionally, it should be noted that one or more components may be combined into a single component providing aggregate functionality or divided into several separate sub-components, and any one or more middle layers, such as a management layer, may be provided to communicatively couple to such sub-components in order to provide integrated functionality. Any components described herein may also interact with one or more other components not specifically described herein but known by those of skill in the art.

In addition, while a particular feature of the subject innovation may have been disclosed with respect to only one of several implementations, such feature may be combined with one or more other features of the other implementations as may be desired and advantageous for any given or particular application. Furthermore, to the extent that the terms "includes," "including," "has," "contains," variants thereof, and other similar words are used in either the detailed description or the claims, these terms are intended to be inclusive in a manner similar to the term "comprising" as an open transition word without precluding any additional or other elements.

As used in this application, the terms "component," "module," "system," or the like are generally intended to refer to a computer-related entity, either hardware (e.g., a circuit), a combination of hardware and software, software, or an entity related to an operational machine with one or more specific functionalities. For example, a component may be, but is not limited to being, a process running on a processor (e.g., digital signal processor), a processor, an object, an executable, a thread of execution, a program, and/or a computer. By way of illustration, both an application running on a controller and the controller can be a component. One or more components may reside within a process and/or thread of execution and a component may be localized on one computer and/or distributed between two or more computers. Further, a "device" can come in the form of specially designed hardware; generalized hardware made specialized by the execution of software thereon that enables the hardware to perform specific function; software stored on a computer readable medium; or a combination thereof.

Moreover, the words "example" or "exemplary" are used herein to mean serving as an example, instance, or illustration. Any aspect or design described herein as "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Computing devices typically include a variety of media, which can include computer-readable storage media and/or communications media, in which these two terms are used herein differently from one another as follows. Computer-readable storage media can be any available storage media that can be accessed by the computer, is typically of a non-transitory nature, and can include both volatile and nonvolatile media, removable and non-removable media. By way of example, and not limitation, computer-readable storage media can be implemented in connection with any method or technology for storage of information such as computer-readable instructions, program modules, structured data, or unstructured data. Computer-readable storage media can include, but are not limited to, RAM, ROM, EEPROM, flash memory or other memory technology, CD-ROM, digital versatile disk (DVD) or other optical disk storage, magnetic cassettes, magnetic tape, magnetic disk storage or other magnetic storage devices, or other tangible and/or non-transitory media which can be used to store desired information. Computer-readable storage media can be accessed by one or more local or remote computing devices, e.g., via access requests, queries or other data retrieval protocols, for a variety of operations with respect to the information stored by the medium.

On the other hand, communications media typically embody computer-readable instructions, data structures, program modules or other structured or unstructured data in a data signal that can be transitory such as a modulated data signal, e.g., a carrier wave or other transport mechanism, and includes any information delivery or transport media. The term "modulated data signal" or signals refers to a signal that has one or more of its characteristics set or changed in such a manner as to encode information in one or more signals. By way of example, and not limitation, communication media include wired media, such as a wired network or direct-wired connection, and wireless media such as acoustic, RF, infrared and other wireless media.

In addition to the various embodiments described herein, it is to be understood that other similar embodiments can be used or modifications and additions can be made to the described embodiment(s) for performing the same or equivalent function of the corresponding embodiment(s) without deviating there from. Accordingly, the invention is not to be limited to any single embodiment, but rather can be construed in breadth, spirit and scope in accordance with the appended claims.

What is claimed is:

1. A urine backsplash, comprising:

a housing that can be placed over a urine cake, and has a plurality of plates substantially parallel to one another, wherein the plurality of plates are oriented to receive a stream of urine and direct flow of the streamed urine along a downward plane of the respective plates toward the urine cake, and mitigate backsplash of the urine to a user; and a set of slots for receiving the plurality of plates.

2. The urine backsplash of claim 1, wherein the plurality of plates are oriented to form an angle from a plane supporting the backsplash and towards the user that is within the range of 10-85 degrees.

3. The urine backsplash of claim 1, further comprising a frame that is cylindrical, and the plurality of plates are mounted to the frame within a circumferential area of the frame.

4. The urine backsplash of claim 3, wherein bottom portions of the plurality of plates rest on top of or above the urine cake.

5. The urine backsplash of claim 1 further comprising a reservoir to house the urine cake.

6. The urine backsplash of claim 1, further comprising a set of sensors that detect presence of fluid striking at least one of the plurality of plates.

7. The urine backsplash of claim 6, further comprising a set of light emitting diodes (LEDs) that trigger upon the set of sensors detecting presence of fluid striking at least one of the plurality of plates.

8. The urine backsplash of claim 1, wherein respective slots of the set of slots are angled for positioning the plurality of plates, respectively.

9. A urine backsplash, comprising:

a housing that can be placed over a urine cake, has a plurality of plates substantially parallel to one another, and a set of slots for receiving the plurality of plates, wherein the plurality of plates are oriented to receive a stream of urine and direct flow of the streamed urine along a downward plane of the respective plates toward the urine cake, and mitigate backsplash of the urine to a user, wherein the plurality of plates are oriented to form an angle from a plane supporting the backsplash and towards the user that is within the range of 10-85 degrees, and wherein bottom portions of the plurality of plates rest on top of or above the urine cake.

10. The urine backsplash of claim 9, further comprising a reservoir to house the urine cake.

11. The urine backsplash of claim 9, further comprising a set of sensors that detect presence of fluid striking at least one of the plurality of plates.

12. The urine backsplash of claim 11, further comprising a set of light emitting diodes (LEDs) that trigger upon the set of sensors detecting presence of fluid striking at least one of the plurality of plates.

13. The urine backsplash of claim 9, wherein respective slots of the set of slots are angled for positioning the plurality of plates, respectively.

14. The urine backsplash of claim 9, wherein the plurality of plates comprise plastic.

15. The urine backsplash of claim 9, wherein the housing comprises plastic.

16. The urine backsplash of claim 9, wherein the plurality of plates comprise paper.

17. The urine backsplash of claim 9, wherein the housing comprises paper.

* * * * *